US010830483B2

(12) United States Patent
Asanuma et al.

(10) Patent No.: US 10,830,483 B2
(45) Date of Patent: Nov. 10, 2020

(54) REFRIGERATION CYCLE APPARATUS

(71) Applicant: Mitsubishi Electric Corporation, Tokyo (JP)

(72) Inventors: Hiroaki Asanuma, Tokyo (JP); Yusuke Shimazu, Tokyo (JP); Hiroki Ishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 16/074,225

(22) PCT Filed: Apr. 14, 2016

(86) PCT No.: PCT/JP2016/061974
§ 371 (c)(1),
(2) Date: Jul. 31, 2018

(87) PCT Pub. No.: WO2017/179165
PCT Pub. Date: Oct. 19, 2017

(65) Prior Publication Data
US 2019/0277534 A1 Sep. 12, 2019

(51) Int. Cl.
*F24F 11/89* (2018.01)
*F24F 11/42* (2018.01)
(Continued)

(52) U.S. Cl.
CPC ..... *F24F 11/89* (2018.01); *F24F 11/42* (2018.01); *F25B 47/025* (2013.01);
(Continued)

(58) Field of Classification Search
CPC ..... F24F 11/89; F24F 11/42; F25B 47/025; F25B 2600/0251; F25B 2700/11;
(Continued)

(56) References Cited

U.S. PATENT DOCUMENTS 8,739,563 B2 * 6/2014 Coussey ..... B64D 13/08 62/140
2015/0040593 A1 * 2/2015 Ariga ..... F24F 1/0003 62/156
2016/0258661 A1 * 9/2016 Taki ..... F25B 49/022

FOREIGN PATENT DOCUMENTS

JP 56-121973 A 9/1981
JP S56121973 * 9/1981
(Continued)

OTHER PUBLICATIONS

English Translation of JPS56121973 (Year: 1981).*
(Continued)

*Primary Examiner* — Marc E Norman
*Assistant Examiner* — Schyler S Sanks
(74) *Attorney, Agent, or Firm* — Posz Law Group, PLC

(57) ABSTRACT

A refrigeration cycle apparatus includes a refrigerant circuit, a fan configured to send air to a heat exchanger, and a controller. The controller is configured to switch among a first operation, a second operation, and a third operation. In the first operation, the heat exchanger is caused to act as an evaporator. In the second operation, the heat exchanger is caused to act as a radiator to defrost the heat exchanger. In the third operation that is performed after the second operation, a compressor is stopped and the fan is operated at a constant rotational speed. The controller is configured to finish the third operation and start the first operation when a physical value positively correlated with electric power supplied to the fan falls to or below a threshold value during the third operation.

6 Claims, 6 Drawing Sheets

(51) Int. Cl.

| | |
|---|---|
| ***F25B 47/02*** | (2006.01) |
| ***F25D 21/00*** | (2006.01) |
| ***F25D 21/02*** | (2006.01) |
| ***F25D 21/12*** | (2006.01) |
| ***F25D 21/06*** | (2006.01) |

(52) U.S. Cl.
CPC ..... *F25D 21/004* (2013.01); *F25D 21/006* (2013.01); *F25D 21/02* (2013.01); *F25D 21/06* (2013.01); *F25D 21/125* (2013.01); *F25B 2600/0251* (2013.01)

(58) Field of Classification Search
CPC ..... F25D 21/004; F25D 21/006; F25D 21/02; F25D 21/06
See application file for complete search history.

(56) References Cited

FOREIGN PATENT DOCUMENTS

| | | | | |
|---|---|---|---|---|
| JP | 07-043061 | A | | 2/1995 |
| JP | 8-261629 | A | | 10/1996 |
| JP | 2003-314931 | A | | 11/2003 |
| JP | 2003314931 | A | * | 11/2003 |
| JP | 4548815 | B2 | | 7/2010 |

OTHER PUBLICATIONS

English Translation of JP-2003314931-A (Year: 2003).*
Extended European Search Report dated May 10, 2019 issued in corresponding EP patent application No. 16898625.5.
International Search Report of the International Searching Authority dated Jun. 28, 2016 for the corresponding international application No. PCT/JP2016/061974 (and English translation).

* cited by examiner

REFRIGERATION CYCLE APPARATUS

CROSS REFERENCE TO RELATED APPLICATION

This application is a U.S. national stage application of PCT/JP2016/061974 filed on Apr. 14, 2016, the contents of which are incorporated herein by reference.

TECHNICAL FIELD

The present invention relates to a refrigeration cycle apparatus capable of operation in which a heat exchanger is caused to act as an evaporator and operation in which the heat exchanger is caused to act as a radiator.

BACKGROUND ART

Patent Literature 1 describes an outdoor unit of an air-conditioning apparatus, the outdoor unit including a heat exchanger, an axial-flow fan driven by a DC motor, a current detection unit configured to detect an electric current value of the DC motor, and a rotation speed detection unit configured to detect rotation speed of the DC motor. In the outdoor unit of the air-conditioning apparatus, rotation speed at start of defrosting and rotation speed at end of defrosting are determined in advance on the basis of a relationship between the rotation speed of the DC motor and an amount of frost formation on the heat exchanger. During heating operation, when the rotation speed detected by the rotation speed detection unit falls to or below the rotation speed at start of defrosting, defrosting operation is started. During defrosting operation, when the rotation speed detected by the rotation speed detection unit rises to or above the rotation speed at end of defrosting, the defrosting operation is finished and heating operation is started.

CITATION LIST

Patent Literature

Patent Literature 1: Japanese Patent No. 4548815

SUMMARY OF INVENTION

Technical Problem

However, with the outdoor unit of the air-conditioning apparatus described in Patent Literature 1, the defrosting operation in which the heat exchanger is caused to act as a condenser is continued until heating operation is resumed after the rotation speed and electric current value of the DC motor, i.e., draft resistance in the outdoor unit, return to their pre-defrosting states. Consequently, the defrosting operation is continued until melt water completely flows down or evaporates from the heat exchanger even after all the frost on the heat exchanger melts. Thus, the outdoor unit of the air-conditioning apparatus described in Patent Literature 1 has a problem of an unnecessarily long run duration spent on defrosting operation, resulting in low energy efficiency.

The present invention has been made to solve the above problem and has an object to provide a refrigeration cycle apparatus capable of improving energy efficiency.

Solution to Problem

A refrigeration cycle apparatus according to an embodiment of the present invention includes a refrigerant circuit including a compressor, a heat exchanger, and a flow switching device configured to switch between a refrigerant flow path that causes the heat exchanger to act as an evaporator and a refrigerant flow path that causes the heat exchanger to act as a radiator, a fan configured to supply air to the heat exchanger, a controller configured to control at least the compressor and the fan, and a detector configured to detect a physical value positively correlated with electric power supplied to the fan. The controller is configured to switch among a first operation, a second operation, and a third operation. In the first operation, the heat exchanger is caused to act as the evaporator. In the second operation, the heat exchanger is caused to act as the radiator to defrost the heat exchanger. In the third operation that is performed after the second operation, the compressor is stopped and the fan is operated at a constant rotational speed. The controller is configured to finish the third operation and start the first operation when the physical value falls to or below a threshold value during the third operation.

Advantageous Effects of Invention

In an embodiment of the present invention, water melted in the heat exchanger by the second operation can be drained by the third operation, making it possible to reduce run duration of the second operation. This configuration improves energy efficiency of the refrigeration cycle apparatus.

DESCRIPTION OF EMBODIMENTS

Embodiment 1

Figure 1:
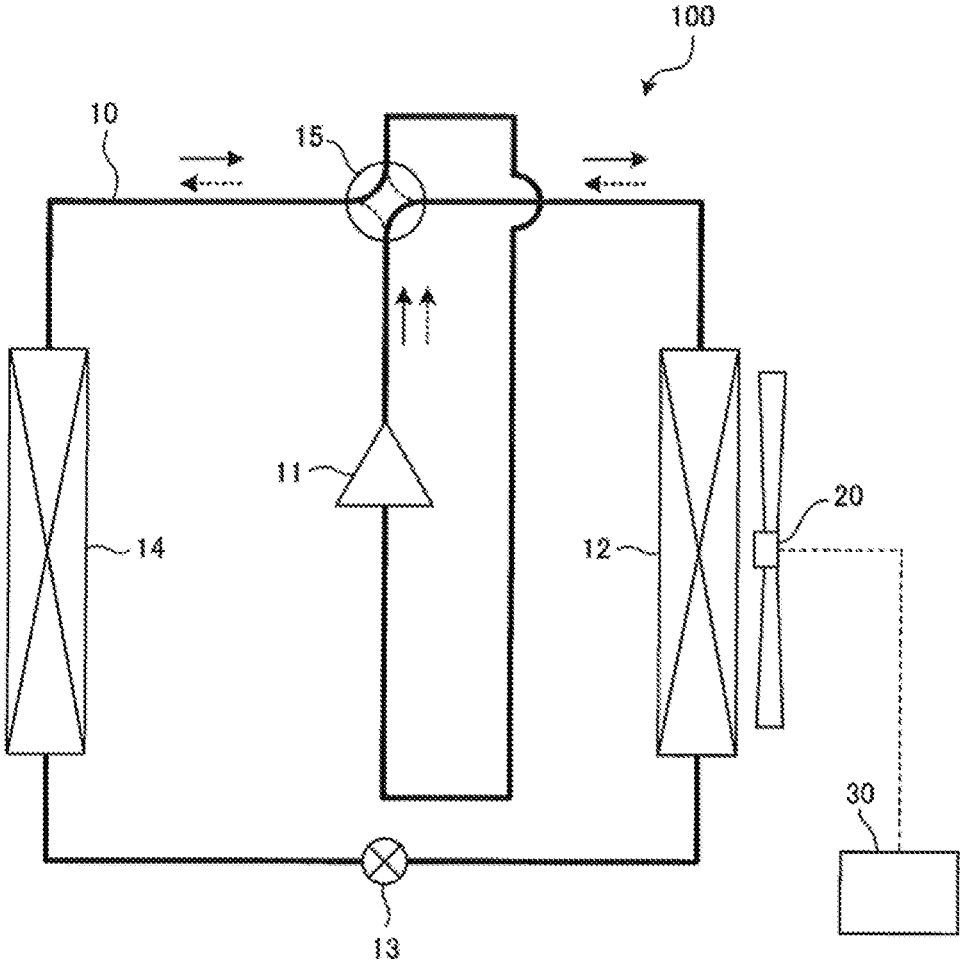
FIG. 1 is a refrigerant circuit diagram showing a schematic configuration of an air-conditioning apparatus 100 according to Embodiment 1 of the present invention.

A refrigeration cycle apparatus according to Embodiment 1 of the present invention will be described. In the present embodiment, an air-conditioning apparatus is illustrated as an example of the refrigeration cycle apparatus. FIG. 1 is a refrigerant circuit diagram showing a schematic configuration of an air-conditioning apparatus 100 according to the present embodiment. As shown in FIG. 1, the air-conditioning apparatus 100 includes a refrigerant circuit 10 configured to circulate refrigerant. The refrigerant circuit 10 has, for example, a configuration in which a compressor 11, a flow switching device 15, a heat source side heat exchanger 12, a decompressor 13, and a load side heat exchanger 14 are annularly connected through refrigerant pipes.

The compressor 11 is a fluid machine configured to compress sucked low-pressure refrigerant and discharge the fluid as high-pressure refrigerant. For example, a variable displacement compressor is used as the compressor 11. In this case, capacity of the compressor 11 is variably controlled by a controller 30 described later. The flow switching device 15 is designed to switch a refrigerant flow path in the refrigerant circuit 10 during cooling operation and that during heating operation. As the flow switching device 15, for example, a four-way valve is used. The heat source side heat exchanger 12 is an air heat exchanger configured to act as a radiator (e.g., a condenser) during cooling operation, and as an evaporator during heating operation. The heat source side heat exchanger 12 allows heat exchange between the refrigerant flowing inside and air supplied by a fan 20 described later. The heat source side heat exchanger 12 is housed, for example, in an outdoor unit installed outdoors.

The decompressor 13 is designed to decompress and thereby convert high-pressure refrigerant into low-pressure refrigerant. For example, an electronic expansion valve or other device capable of adjusting an opening degree under control of the controller 30 is used as the decompressor 13. The load side heat exchanger 14 acts as an evaporator during cooling operation, and as a radiator (e.g., a condenser) during heating operation. The load side heat exchanger 14 allows heat exchange between the refrigerant flowing inside and indoor air supplied by a non-illustrated fan, for example. The load side heat exchanger 14 is housed, for example, in an indoor unit installed in the room.

The type of refrigerant filled into the refrigerant circuit 10 is not limited. For example, a non-azeotropic refrigerant mixture, such as a refrigerant mixture of R32 and HFO-1234yf, having a temperature glide in evaporating temperature or condensing temperature can be used.

Also, the air-conditioning apparatus 100 includes a fan 20 configured to supply air (e.g., outdoor air) to the heat source side heat exchanger 12. The fan 20 of the present example is located downstream of the heat source side heat exchanger 12 in a direction of an air flow generated by operation of the fan 20, and is placed facing the heat source side heat exchanger 12. As the fan 20, for example, an axial fan or centrifugal fan is used. The fan 20 is equipped with an impeller and a motor configured to rotationally drive the impeller. The motor of the fan 20 is supplied with electric power from a non-illustrated power supply unit. Rotational speed of the fan 20 is controlled by the controller 30. Specifically, an electric current or voltage input to the motor of the fan 20 from the power supply unit is controlled by the controller 30, thereby controlling the rotational speed of the fan 20. As the rotational speed of the fan 20 is controlled, a flow rate of air supplied from the fan 20 to the heat source side heat exchanger 12 is adjusted.

On the basis of detection signals from various sensors and other factor, the controller 30 controls operation of the entire air-conditioning apparatus 100 including the compressor 11, decompressor 13, flow switching device 15, and fan 20. To implement the function of controlling the operation of the air-conditioning apparatus 100, the controller 30 is made up, for example, of hardware such as a circuit device on which a microcomputer or CPU is mounted or software executed by an arithmetic unit such as a microcomputer or CPU.

The controller 30 controls voltage or electric current input to the fan 20 from the power supply unit. Consequently, the controller 30 also acts as a detector configured to detect a physical value positively correlated with electric power supplied to the fan 20. The physical value includes electric energy, an amount of change in the electric energy, total electric energy, an electric current flowing through the fan 20, a voltage applied to the fan 20, and other variables as well as the electric power itself supplied to the fan 20. In the following description, electric power is an example of the physical value positively correlated with electric power supplied to the fan 20. The rotational speed of the fan 20 can be detected by a sensor configured to detect rotational speed or estimated on the basis of a physical value such as the electric current, voltage, and electric power input to the fan 20.

Next, operation of the refrigerant circuit 10 will be described. First, actions of cooling operation will be described. In FIG. 1, solid arrows indicate directions of refrigerant flow during cooling operation. In performing cooling operation, the controller 30 controls the flow switching device 15 so that high-pressure refrigerant discharged from the compressor 11 will flow into the heat source side heat exchanger 12. Consequently, flow paths in the flow switching device 15 are switched as indicated by solid lines in FIG. 1.

High-temperature, high-pressure gas refrigerant discharged from the compressor 11 flows into the heat source side heat exchanger 12 through the flow switching device 15. In cooling operation, the heat source side heat exchanger 12 acts as a radiator (condenser, in the present example). That is, the heat source side heat exchanger 12 allows heat exchange between the refrigerant flowing inside and outdoor air supplied by the fan 20, and heat of condensation of the refrigerant is transferred to the outdoor air. Consequently, the gas refrigerant flowing into the heat source side heat exchanger 12 is condensed into high-pressure liquid refrigerant. The high-pressure liquid refrigerant flowing out of the heat source side heat exchanger 12 flows into the decompressor 13 and is decompressed into low-pressure two-phase refrigerant. The low-pressure two-phase refrigerant flowing out of the decompressor 13 flows into the load side heat exchanger 14. In cooling operation, the load side heat exchanger 14 acts as an evaporator. That is, the load side heat exchanger 14 allows heat exchange between the refrigerant flowing inside and an external fluid (e.g., indoor air), and heat of evaporation of the refrigerant is received from the external fluid. Consequently, the two-phase refrigerant flowing into the load side heat exchanger 14 evaporates and becomes low-pressure gas refrigerant (or high-quality two-phase refrigerant). Also, the external fluid is cooled by endothermic effect of the refrigerant. The low-pressure gas refrigerant flowing out of the load side heat exchanger 14 is sucked into the compressor 11 through the flow switching device 15. The refrigerant sucked into the compressor 11 is compressed and thereby becomes high-temperature, high-pressure gas refrigerant. During cooling operation, the above cycle is repeated continuously in the refrigerant circuit 10.

Next, actions of heating operation (an example of first operation) will be described. In FIG. 1, broken line arrows indicate directions of refrigerant flow during heating operation. In performing heating operation, the controller 30 controls the flow switching device 15 so that the high-pressure refrigerant discharged from the compressor 11 will flow into the load side heat exchanger 14. Consequently, the flow paths in the flow switching device 15 are switched as indicated by broken lines in FIG. 1.

The high-temperature, high-pressure gas refrigerant discharged from the compressor 11 flows into the load side heat exchanger 14 through the flow switching device 15. In heating operation, the load side heat exchanger 14 acts as a radiator (condenser, in the present example). That is, the load side heat exchanger 14 allows heat exchange between the refrigerant flowing inside and an external fluid (e.g., indoor air), and heat of condensation of the refrigerant is transferred to the external fluid. Consequently, the gas refrigerant flowing into the load side heat exchanger 14 is condensed into high-pressure liquid refrigerant. Also, the external fluid is heated by heat transfer effect of the refrigerant. The high-pressure liquid refrigerant flowing out of the load side heat exchanger 14 flows into the decompressor 13 and is decompressed into low-pressure two-phase refrigerant. The low-pressure two-phase refrigerant flowing out of the decompressor 13 flows into the heat source side heat exchanger 12. In heating operation, the heat source side heat exchanger 12 acts as an evaporator. That is, the heat source side heat exchanger 12 allows heat exchange between the refrigerant flowing inside and outdoor air supplied by the fan 20, and heat of evaporation of the refrigerant is received from the outdoor air. Consequently, the two-phase refrigerant flowing into the heat source side heat exchanger 12 evaporates and becomes low-pressure gas refrigerant (or high-quality two-phase refrigerant). The low-pressure gas refrigerant flowing out of the heat source side heat exchanger 12 is sucked into the compressor 11 through the flow switching device 15. The refrigerant sucked into the compressor 11 is compressed and thereby becomes high-temperature, high-pressure gas refrigerant. During heating operation, the above cycle is repeated continuously in the refrigerant circuit 10.

While heating operation is performed, when outside air temperature is low, frost formation occurs, in which frost and ice attach to surfaces of the heat source side heat exchanger 12. An amount of frost formation on the heat source side heat exchanger 12 increases in proportion to duration of the heating operation. The controller 30 performs defrosting operation (an example of second operation), for example, when it is determined that the amount of frost formation on the heat source side heat exchanger 12 has reached or exceeded a predetermined amount. In performing the defrosting operation, the controller 30 controls the flow switching device 15 so that high-pressure refrigerant discharged from the compressor 11 will flow into the heat source side heat exchanger 12 as in the case of cooling operation. Consequently, the flow paths in the flow switching device 15 are switched as indicated by solid lines in FIG. 1. In defrosting operation, the heat source side heat exchanger 12 acts as a radiator (condenser, in the present example), and the frost and ice attaching to the surfaces of the heat source side heat exchanger 12 is melted by heat transfer effect of the refrigerant. Water into which the frost and ice are melted is drained by allowing the water to flow down from the surfaces of the heat source side heat exchanger 12.

Figure 2:
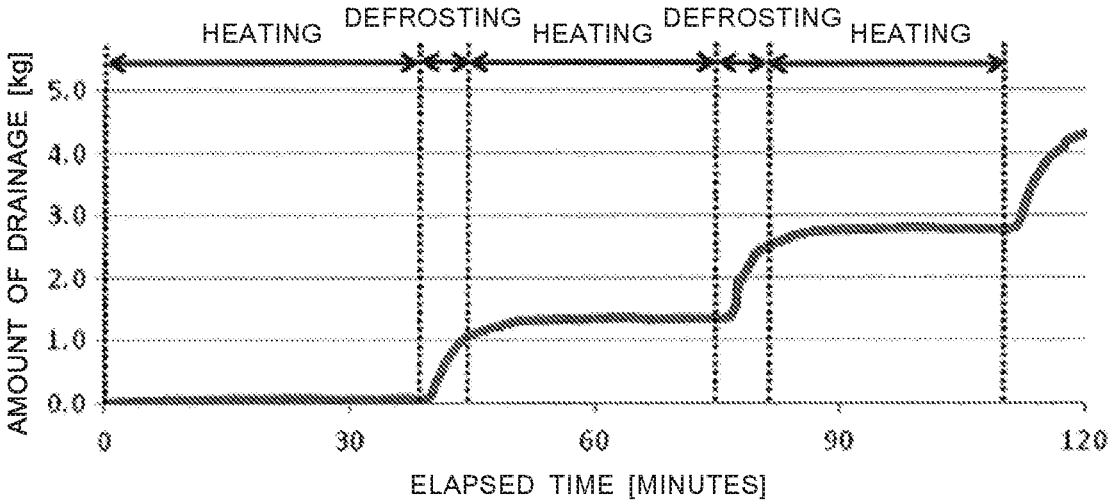
FIG. 2 is a graph showing time variation in an amount of drainage from a heat source side heat exchanger 12 when heating operation and defrosting operation are performed repeatedly in the air-conditioning apparatus 100 according to Embodiment 1 of the present invention.

FIG. 2 is a graph showing time variation in an amount of drainage from the heat source side heat exchanger 12 when heating operation and defrosting operation are performed repeatedly in the air-conditioning apparatus 100 according to the present embodiment. The abscissa of the graph represents elapsed time [minutes] and the ordinate represents a cumulative amount of drainage [kg]. As shown in FIG. 2, the amount of drainage from the heat source side heat exchanger 12 increases during the period of defrosting operation in which frost and ice are melted. However, the amount of drainage from the heat source side heat exchanger 12 increases even after the defrosting operation is finished and heating operation is started. This means that when drainage capacity of the heat source side heat exchanger 12 is low, drainage from the heat source side heat exchanger 12 is not completed even after defrosting operation is finished and drainage continues even after the heating operation is started. When the heating operation is started before drainage from the heat source side heat exchanger 12 is completed, water left undrained may freeze in the heat source side heat exchanger 12.

On the other hand, when defrosting operation is performed until drainage from the heat source side heat exchanger 12 is fully completed, run duration of the defrosting operation becomes unnecessarily long, which may result in low energy efficiency of the air-conditioning apparatus 100.

Consequently, according to the present embodiment, before heating operation is resumed after defrosting operation is finished, draining operation is performed in preparation for heating operation. The draining operation is performed, for example, at the time when frost and ice on the heat source side heat exchanger 12 are melted by defrosting operation. That is, the defrosting operation is finished without waiting for drainage from the heat source side heat exchanger 12 to be completed. To perform draining operation, the controller 30 stops the compressor 11 and operates the fan 20 at a fixed rotational speed.

Before the drainage from the heat source side heat exchanger 12 is completed, part of an airflow path in the heat source side heat exchanger 12 is blocked by water, and thus draft resistance is higher than that after the drainage from the heat source side heat exchanger 12 is completed. When draft resistance in the heat source side heat exchanger 12 is high, the controller 30 increases the electric current passed through the motor of the fan 20, and thereby keeps the rotational speed of the fan 20 at a fixed value. Thus, before the drainage from the heat source side heat exchanger 12 is completed, electric power larger than that after the drainage from the heat source side heat exchanger 12 is completed is supplied to the motor of the fan 20. When the drainage from the heat source side heat exchanger 12 progresses, the draft resistance in the heat source side heat exchanger 12 decreases, and thus electric power supplied to the motor of the fan 20 decreases gradually with the progress of drainage from the heat source side heat exchanger 12. A threshold value W0 [W] of electric power is stored as a standard value in a ROM of the controller 30. The threshold value W0 is equal to a value of the electric power supplied to the fan 20 for example, when the rotational speed of the fan 20 is kept at the fixed value described above with no water attached to the heat source side heat exchanger 12. During draining operation, by comparing the electric power supplied to the fan 20 with the threshold value W0, the progress of drainage from the heat source side heat exchanger 12 can be estimated.

For example, the controller 30 continues draining operation until the electric power W [W] supplied to the fan 20 falls to or below the threshold value W0 ($W \leq W0$), and finishes the draining operation and resumes heating operation when the electric power W becomes equal to or lower than the threshold value W0. This makes it possible to resume heating operation without any water or other matter attached to the heat source side heat exchanger 12.

Figure 3:
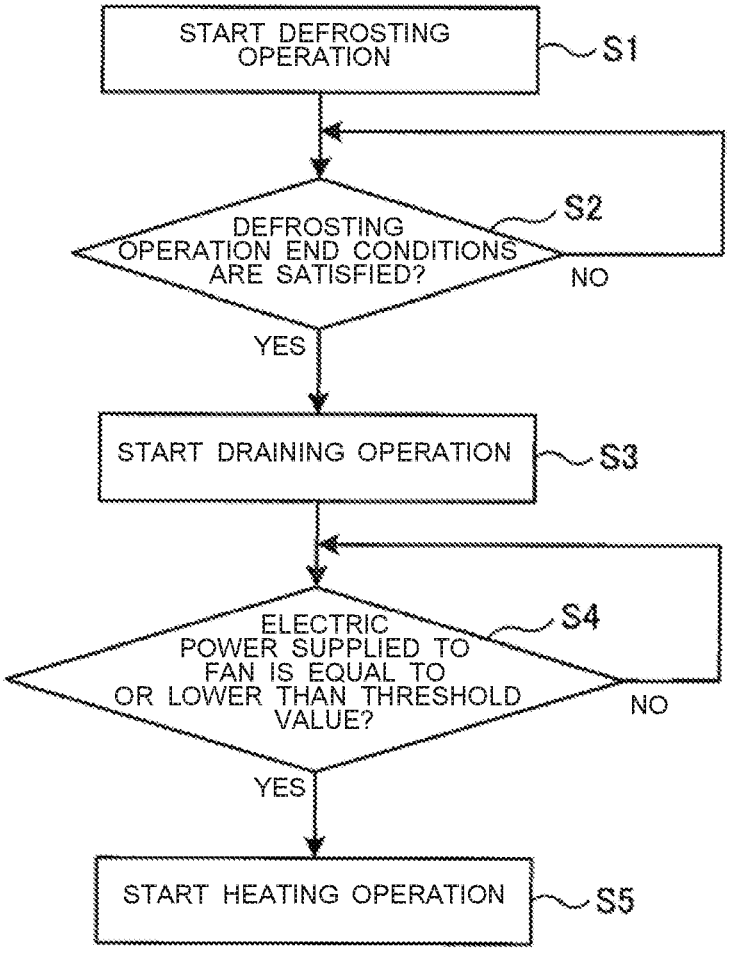
FIG. 3 is a flowchart showing an exemplary flow of processing performed by a controller 30 of the air-conditioning apparatus 100 according to Embodiment 1 of the present invention.

FIG. 3 is a flowchart showing an exemplary flow of processing performed by the controller 30 of the air-conditioning apparatus 100 according to the present embodiment.

Figure 4:
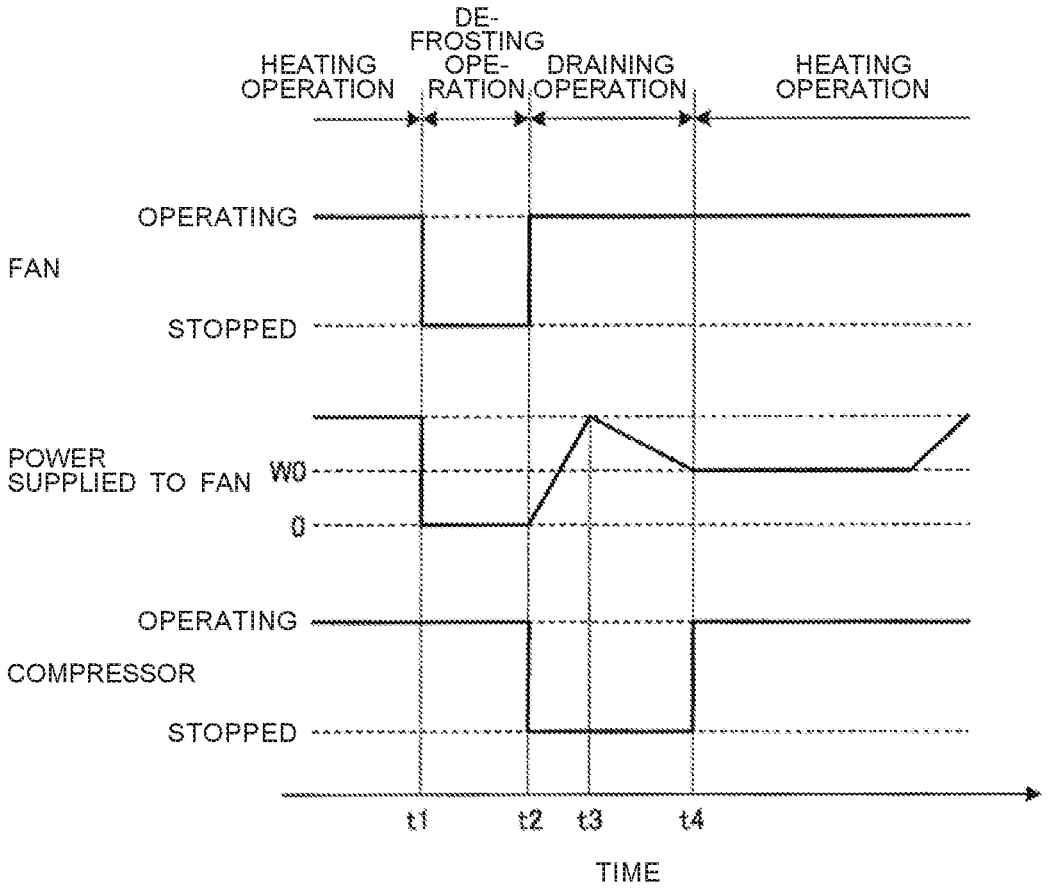
FIG. 4 is a graph showing an example of time variation in operating status of the air-conditioning apparatus 100 according to Embodiment 1 of the present invention.

FIG. 4 is a graph showing an example of time variation in operating status of the air-conditioning apparatus 100 according to the present embodiment.

During heating operation (an example of first operation), when it is determined that a predetermined defrosting operation start conditions are satisfied, the controller 30 finishes the heating operation and starts defrosting operation (an example of second operation) (step S1 in FIG. 3, time t1 in FIG. 4). Here, whether or not the defrosting operation start conditions are satisfied is determined on the basis of, for example, the duration of heating operation, outside air temperature, temperature of the heat source side heat exchanger 12, amount of frost formation on the heat source side heat exchanger 12, and other factor. When defrosting operation is started, the controller 30 controls the flow switching device 15 so that high-pressure refrigerant discharged from the compressor 11 will flow into the heat source side heat exchanger 12. Also, when the defrosting operation is started, the controller 30 stops the fan 20.

In step S2, the controller 30 determines whether or not predetermined defrosting operation end conditions are satisfied (step S2). When it is determined that defrosting operation end conditions are satisfied, the controller 30 proceeds to the process of step S3. When it is determined that defrosting operation end conditions are not satisfied, the controller 30 repeats the process of step S2. Here, whether or not the defrosting operation end conditions are satisfied is determined on the basis of, for example, the run duration of the defrosting operation, outside air temperature, temperature of the heat source side heat exchanger 12, amount of frost formation on the heat source side heat exchanger 12, and other factor. Desirably, the defrosting operation end conditions are set to be satisfied when melting of the frost and ice on the heat source side heat exchanger 12 is completed.

In step S3, the controller 30 finishes the defrosting operation and starts draining operation (an example of third operation) (time t2 in FIG. 4). When the draining operation is started, the controller 30 stops the compressor 11 and operates the fan 20 at a fixed rotational speed. Also, the controller 30 monitors the electric power supplied to the fan 20. The electric power supplied to the fan 20 increases along with increases in the rotational speed on start-up of the fan 20 (time t2 to time t3 in FIG. 4), and after a target rotational speed is reached, the electric power decreases gradually with the progress of drainage from the heat source side heat exchanger 12 (time t3 to time t4 in FIG. 4).

In step S4, the controller 30 determines whether or not the electric power W supplied to the fan 20 is equal to or lower than the threshold value W0. When it is determined that the electric power W is equal to or lower than the threshold value W0, the controller 30 proceeds to the process of step S5. When it is determined that the electric power W is higher than the threshold value W0, the controller 30 repeats the process of step S4.

In step S5, the controller 30 finishes the draining operation and starts heating operation (time t4 in FIG. 4). When the heating operation is started, the controller 30 starts operating the compressor 11.

As described above, the air-conditioning apparatus 100 (an example of a refrigeration cycle apparatus) according to the present embodiment includes the refrigerant circuit 10 including the compressor 11, the heat source side heat exchanger 12 (an example of a heat exchanger), and the flow switching device 15 configured to switch between a refrigerant flow path that causes the heat source side heat exchanger 12 to act as an evaporator and a refrigerant flow path that causes the heat source side heat exchanger 12 to act as a radiator, the fan 20 configured to supply air to the heat source side heat exchanger 12, the controller 30 configured to control at least the compressor 11 and the fan 20, and a detector (e.g., the controller 30) configured to detect a physical value (e.g., the electric power supplied to the fan 20) positively correlated with the electric power supplied to the fan 20. The controller 30 is configured to switch among heating operation (an example of first operation), defrosting operation (an example of second operation), and draining operation (an example of third operation). The heating operation causes the heat source side heat exchanger 12 to act as an evaporator. The defrosting operation causes the heat source side heat exchanger 12 to act as a radiator to defrost the heat source side heat exchanger 12. In the draining operation that is performed after the defrosting operation, the compressor 11 is stopped and the fan 20 is operated at a constant rotational speed. The controller 30 is configured to finish the draining operation and start the heating operation when the physical value described above falls to or below a threshold value during the draining operation.

According to the present embodiment, as the draining operation is performed after defrosting operation is finished, but before heating operation is started, the water melted by the defrosting operation can be drained from the heat source side heat exchanger 12 during the draining operation, making it possible to reduce the run duration of the defrosting operation. This configuration improves energy efficiency of the air-conditioning apparatus 100.

Also, according to the present embodiment, the draining operation is continued until the physical value positively correlated with the electric power supplied to the fan 20 falls to or below the threshold value. This makes it possible to prevent heating operation from being started when the water melted by the defrosting operation is left undrained from the heat source side heat exchanger 12. This in turn makes it possible to prevent water from being frozen in the heat source side heat exchanger 12 in heating operation, and thereby prevent breakage of the heat source side heat exchanger 12 and reduction in heating capacity of the air-conditioning apparatus 100. Thus, reliability and performance of the air-conditioning apparatus 100 can be improved.

Should water freeze in the heat source side heat exchanger 12, the run duration of next defrosting operation may become longer. In contrast, the present embodiment can prevent water from freezing in the heat source side heat exchanger 12, and thus improve operating efficiency and energy efficiency of the air-conditioning apparatus 100.

Also, as there is no need to operate the fan 20 during defrosting operation, the present embodiment can improve defrosting efficiency.

Figure 5:
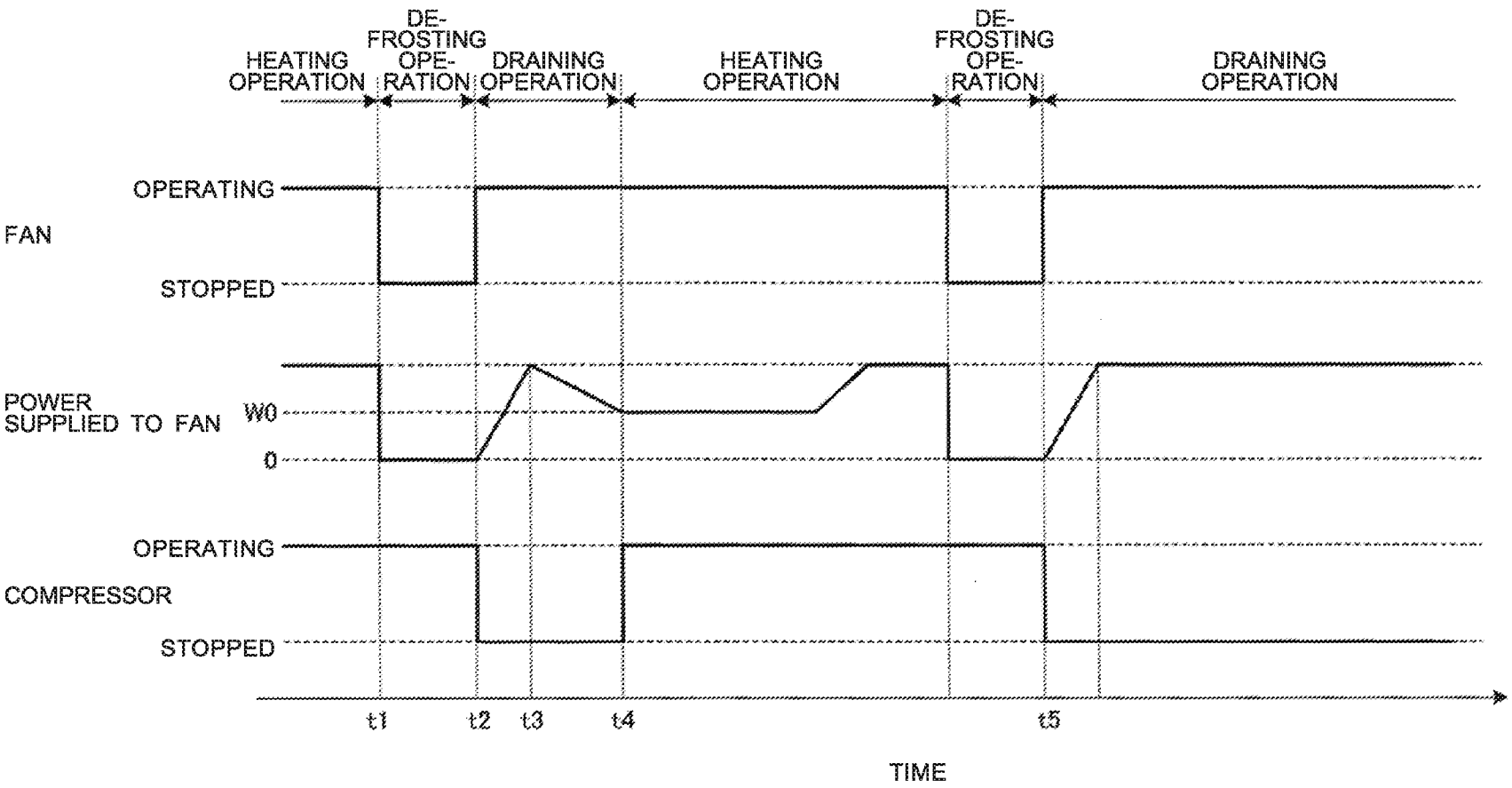
FIG. 5 is a diagram showing an example of an operation test on the air-conditioning apparatus 100 according to Embodiment 1 of the present invention.

FIG. 5 is a diagram showing an example of an operation test on the air-conditioning apparatus 100 according to the present embodiment. The operation test can determine whether or not the air-conditioning apparatus 100 operates properly by using two cycles of normal heating operation without making the air-conditioning apparatus 100 perform a special operation.

In a first cycle of operation that begins with an end of heating operation and ends with a start of next heating operation, actions similar to those in FIG. 4 are performed. During draining operation (time t2 to time t4) in the first cycle, a check is made to see that the compressor 11 starts after the electric power supplied to the fan 20 falls and a check is made on the value of electric power on start-up of the compressor 11. During draining operation (time t5 and later) in the second cycle, a check is made to see that the compressor 11 does not start unless the electric power supplied to the fan 20 falls to the start-up value described above. For example, by covering the heat source side heat exchanger 12 with gauze or other material, the draft resistance in the heat source side heat exchanger 12 is increased intentionally to make sure that the electric power supplied to the fan 20 does not fall to the start-up value described above even after the drainage from the heat source side heat exchanger 12 is completed.

Through the above procedures, checks are made to ensure that the compressor 11 starts after the electric power supplied to the fan 20 falls to a predetermined value and that the compressor 11 does not start unless the electric power supplied to the fan 20 falls to the predetermined value described above. When these two points are verified, it can be determined that the air-conditioning apparatus 100 is operating properly in characteristic part of the present embodiment. In other words, any air-conditioning apparatus for which the two points described above are verified, is likely to match the configuration of the present embodiment.

Embodiment 2

A refrigeration cycle apparatus according to Embodiment 2 of the present invention will be described. The present embodiment concerns a process performed when a predetermined time elapses before the electric power supplied to the fan 20 falls to or below a threshold value during draining operation.

Figure 6:
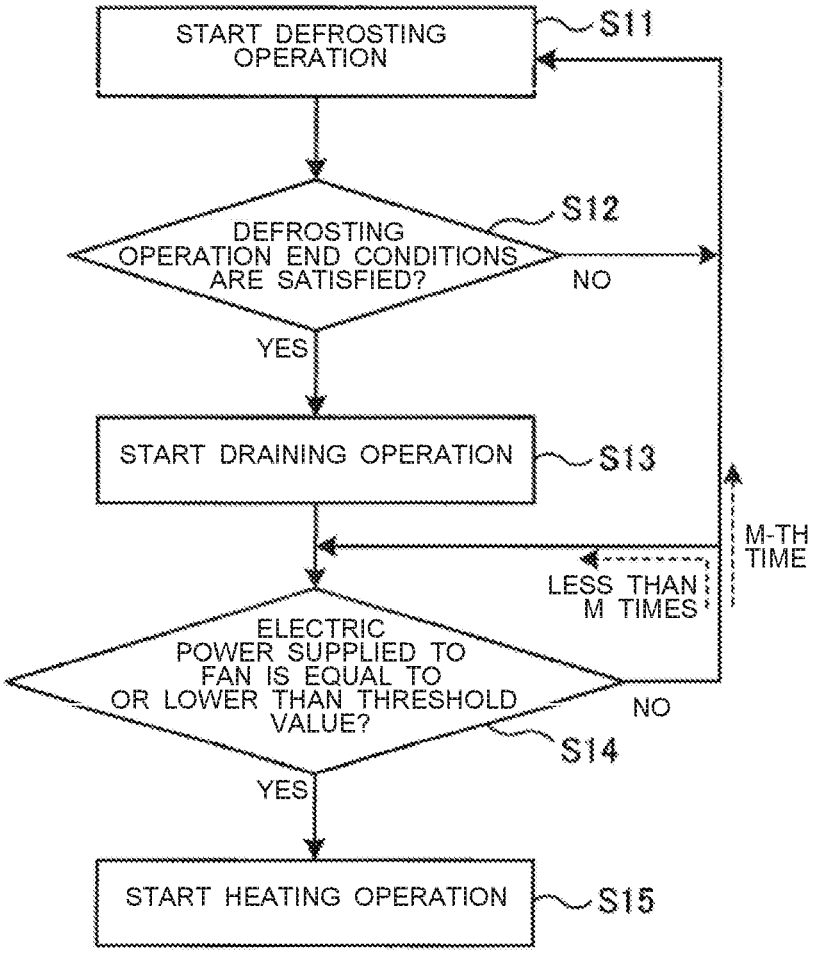
FIG. 6 is a flowchart showing an exemplary flow of processing performed by a controller 30 of an air-conditioning apparatus 100 according to Embodiment 2 of the present invention.

FIG. 6 is a flowchart showing an exemplary flow of processing performed by the controller 30 of the air-conditioning apparatus 100 according to the present embodiment. Steps S11 to S13 in FIG. 6 are similar to Steps S1 to S3 in FIG. 3.

In step S14, the controller 30 determines whether or not the electric power W supplied to the fan 20 is equal to or lower than the threshold value W0. When it is determined that the electric power W is equal to or lower than the threshold value W0, the controller 30 proceeds to the process of step S15. When it is determined that the electric power W is higher than the threshold value W0, the controller 30 repeats the process of step S14. However, when it is determined m times successively in step S14 that the electric power W is higher than the threshold value W0, the controller 30 returns to step S11, not step S14. That is, during draining operation, when a predetermined time elapses before the electric power W falls to or below a threshold value W0, the controller 30 finishes the draining operation and resumes defrosting operation. This is because a judgment that when a predetermined time elapses before the electric power W falls to or below the threshold value W0 during draining operation, it is highly likely that there remain frost and ice with the incompleted defrosting of the heat source side heat exchanger 12. The value of m is set in advance on the basis of a period from when the draining operation is started to when the defrosting operation is resumed and an execution cycle of the processing shown in FIG. 6.

When defrosting operation and draining operation are performed again and if it is determined in step S14 that the electric power W is equal to or lower than the threshold value W0, the controller 30 proceeds to the process of step S15 and resumes heating operation.

As described above, the air-conditioning apparatus 100 according to the present embodiment is configured so that when a predetermined time elapses before the physical value falls to or below the threshold value during draining operation, the controller 30 will finish the draining operation and start defrosting operation as the second run of defrosting operation (an example of fourth operation).

With this configuration, as defrosting operation can be resumed when defrosting of the heat source side heat exchanger 12 cannot be completed by a single run of defrosting operation, defrosting of the heat source side heat exchanger 12 can be completed reliably before heating operation is started.

Embodiment 3

Figure 7:
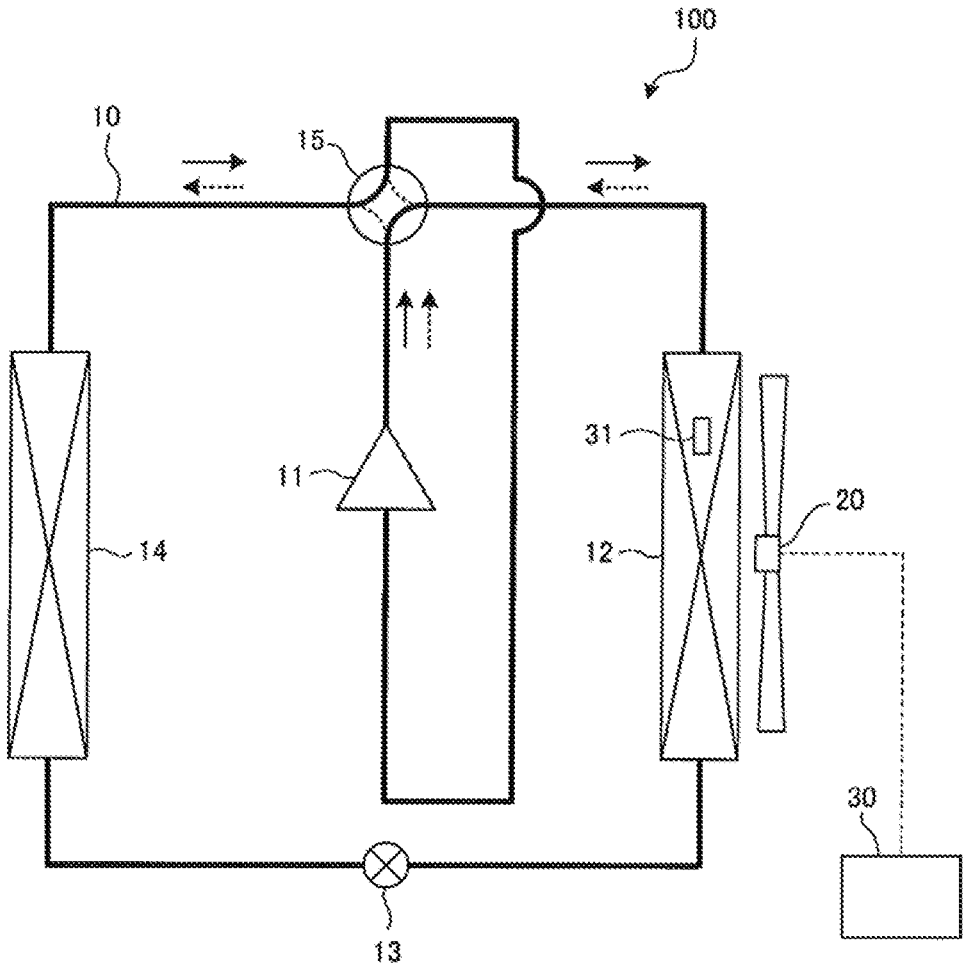
FIG. 7 is a refrigerant circuit diagram showing a schematic configuration of an air-conditioning apparatus 100 according to Embodiment 3 of the present invention.

A refrigeration cycle apparatus according to Embodiment 3 of the present invention will be described. FIG. 7 is a refrigerant circuit diagram showing a schematic configuration of an air-conditioning apparatus 100 according to the present embodiment. As shown in FIG. 7, the air-conditioning apparatus 100 according to the present embodiment includes a temperature sensor 31 configured to measure surface temperature of the heat source side heat exchanger 12 or refrigerant temperature in the heat source side heat exchanger 12. The temperature sensor 31 can also serve as a two-phase pipe temperature sensor configured to detect, for example, evaporating temperature during heating operation and condensing temperature during cooling operation.

According to the present embodiment, an end condition (second end condition) for the second and subsequent runs of defrosting operation before resumption of heating operation according to Embodiment 2 described above is set to be stricter than an end condition (first end condition) for the previous or first run of defrosting operation. That is, there are such relationships between the first end condition and second end condition that when the second end condition is satisfied, the first end condition is also satisfied, but that the second end condition is not always satisfied even when the first end condition is satisfied.

For example, the first end condition and second end condition are set using temperature Te of the heat source side heat exchanger 12 measured with the temperature sensor 31. In the present example, as threshold values of the temperature Te, a first threshold temperature T1 and a second threshold temperature T2 that is higher than the first threshold temperature T1 are set (T1<T2). The second threshold temperature T2 is higher than the first threshold temperature T1, for example, by 1 degree. For example, the first end condition is that the temperature Te satisfies a relationship of Te >T1 and the second end condition is that the temperature Te satisfies a relationship of Te>T2. Consequently, the second end condition is set to be stricter than the first end condition.

As described above, the air-conditioning apparatus 100 according to the present embodiment is configured so that the controller 30 will finish defrosting operation and start draining operation (an example of third operation) when the first end condition is satisfied during the defrosting operation (an example of second operation) and finish the second run of defrosting operation and start draining operation when the second end condition that is stricter than the first end condition is satisfied during the second run of defrosting operation (an example of fourth operation).

With this configuration, even when some frost remains unmelted after the first run of defrosting operation, the frost can be melted more reliably to the last bit by the second run of defrosting operation.

Also, the air-conditioning apparatus 100 according to the present embodiment may be configured so that the controller 30 will finish the defrosting operation and start draining operation when the temperature Te of the heat source side heat exchanger 12 becomes higher than the first threshold temperature T1 during defrosting operation and finish the second run of defrosting operation and start draining operation when the temperature Te of the heat source side heat exchanger 12 becomes higher than the second threshold temperature T2 during the second run of defrosting operation. Also, the second threshold temperature T2 may be higher than the first threshold temperature T1.

Embodiment 4

A refrigeration cycle apparatus according to Embodiment 4 of the present invention will be described. According to the present embodiment, run duration of each of the second and subsequent runs of defrosting operation before resumption of heating operation according to Embodiment 2 or 3 described above is set shorter than the previous or first run of defrosting operation. This is because, when the second and subsequent runs of defrosting operation are performed, as defrosting has been completed to some extent by the first run of defrosting operation, there is thought to be no need to set the run duration of each of the second and subsequent runs of defrosting operation as long as the first run of defrosting operation. For example, when the run duration of the first run of defrosting operation is set to 2 minutes, the run duration of the second run of defrosting operation is set to 1 minute.

That is, the air-conditioning apparatus 100 according to the present embodiment is configured so that the controller 30 will finish defrosting operation and start draining operation when the run duration of the defrosting operation exceeds a first threshold time and finish the second run of defrosting operation and start draining operation when the run duration of the second run of defrosting operation exceeds a second threshold time that is shorter than the first threshold time.

With this configuration, the run duration of each of the second and subsequent runs of defrosting operation before resumption of heating operation can be reduced, making it possible to improve the energy efficiency of the air-conditioning apparatus 100.

Embodiment 5

A refrigeration cycle apparatus according to Embodiment 5 of the present invention will be described. In Embodiments 1 to 4 described above, timing to start heating operation is determined on the basis of the electric power W supplied to the fan 20. In contrast, according to the present embodiment, the timing to start heating operation is determined on the basis of an integrated value ΣW of electric power W supplied to the fan 20, for example, for the latest n minutes, not an instantaneous value of electric power W. For example, the controller 30 continues draining operation until the integrated value ΣW falls to or below a threshold value ΣW0 and finishes the draining operation and starts the heating operation when the integrated value ΣW falls to or below the threshold value ΣW0.

Also, an amount of change ΔW in the electric power W supplied to the fan 20 may be calculated by the controller 30 to determine the timing to start heating operation on the basis of an integrated value ΣΔW of the amount of change ΔW. For example, the controller 30 continues draining operation until the integrated value ΣΔW falls to or below a threshold value ΣΔW0 and finishes the draining operation and starts the heating operation when the integrated value ΣΔW falls to or below the threshold value ΣΔW0.

Embodiment 6

A refrigeration cycle apparatus according to Embodiment 6 of the present invention will be described. In Embodiments 1 to 5 described above, the timing to start heating operation is determined on the basis of the electric power W supplied to the fan 20. In contrast, according to the present embodiment, the timing to start heating operation is determined on the basis of a physical value (e.g., electric current, voltage, speed command voltage of the fan motor, and other variables) related to the electric power W supplied to the fan 20.

Embodiment 7

In the embodiments described above, whether or not the drainage from the heat source side heat exchanger 12 has been completed is determined on the basis of the electric power supplied to the fan 20. According to the present embodiment, frosting state of the heat source side heat exchanger 12, clogging of the heat source side heat exchanger 12 with dust and other matter, or fan efficiency reduction due to aging deterioration is checked on the basis of the electric power supplied to the fan 20. This makes it possible to detect frosting state of the heat source side heat exchanger 12, clogging of the heat source side heat exchanger 12 with dust and other matter, or fan efficiency reduction due to aging deterioration.

Other Embodiments

The present invention is not limited to the embodiments described above, and various modifications are possible.

For example, whereas in the above embodiments, the air-conditioning apparatus 100 in which the heat source side heat exchanger 12 is to be defrosted has been described as an example, the present invention is also applicable to an air-conditioning apparatus in which the load side heat exchanger 14 is to be defrosted. In this case, defrosting operation (an example of second operation) is started when predetermined conditions are satisfied during cooling operation (an example of first operation). Draining operation (an example of third operation) is started when predetermined conditions are satisfied during defrosting operation. In the draining operation, a load side fan configured to supply air to the load side heat exchanger 14 is operated at a constant rotational speed with the compressor 11 stopped. During draining operation, when a physical value positively correlated with electric power supplied to the load side fan falls to or below the threshold value, the controller 30 finishes the draining operation and resumes cooling operation.

Also, whereas in the above embodiments, the air-conditioning apparatus 100 has been described as an example of a refrigeration cycle apparatus, the present invention is also applicable to a refrigeration cycle apparatus other than an air-conditioning apparatus.

Also, the above embodiments and variations may be implemented in combination.

REFERENCE SIGNS LIST

10 refrigerant circuit 11 compressor 12 heat source side heat exchanger 13 decompressor 14 load side heat exchanger 15 flow switching device 20 fan 30 controller 31 temperature sensor 100 air-conditioning apparatus

The invention claimed is:

1. A refrigeration cycle apparatus comprising:

a refrigerant circuit including a compressor, a heat exchanger, and a flow switching valve configured to switch between a refrigerant flow path that causes the heat exchanger to act as an evaporator and a refrigerant flow path that causes the heat exchanger to act as a radiator;

a fan configured to supply air to the heat exchanger;

a controller configured to control at least the compressor and the fan; and a detector configured to detect a physical value positively correlated with electric power supplied to the fan, the physical value being any of an electric current flowing through the fan, a voltage applied to the fan, and the electric power, the controller being configured to switch among a first operation, a second operation, and a third operation, in the first operation, the heat exchanger is caused to act as the evaporator, in the second operation, the heat exchanger is caused to act as the radiator to defrost the heat exchanger, in the third operation that is performed after the second operation, the compressor being stopped and the fan being operated at a constant rotational speed to perform a draining operation to drain water melted by the second operation from the heat exchanger, and the controller being configured to finish the third operation and start the first operation when the physical value falls to or below a threshold value during the third operation.

2. The refrigeration cycle apparatus of claim 1, wherein the controller is configured to finish the third operation and start the second operation as a fourth operation when a predetermined time elapses before the physical value falls to or below the threshold value during the third operation.

3. The refrigeration cycle apparatus of claim 2, wherein the controller is configured to finish the second operation and start the third operation when a first end condition is satisfied during the second operation, and finish the fourth operation and start the third operation when a second end condition that is stricter than the first end condition is satisfied during the fourth operation.

4. The refrigeration cycle apparatus of claim 2, wherein the controller is configured to finish the second operation and start the third operation when temperature of the heat exchanger becomes higher than a first threshold temperature during the second operation, and finish the fourth operation and start the third operation when the temperature of the heat exchanger becomes higher than a second threshold temperature during the fourth operation.

5. The refrigeration cycle apparatus of claim 4, wherein the second threshold temperature is higher than the first threshold temperature.

6. The refrigeration cycle apparatus of claim 2, wherein the controller is configured to finish the second operation and start the third operation when a run duration of the second operation exceeds a first threshold time, and finish the fourth operation and start the third operation when a run duration of the fourth operation exceeds a second threshold time that is shorter than the first threshold time.

* * * * *